United States Patent [19]

Russenberger

[11] 4,368,368

[45] Jan. 11, 1983

[54] ELECTRICAL SWITCH WITH A VERTICAL PUSH-PIECE

[76] Inventor: Victor Russenberger, 40 rue de la Source, 94130 Nogent-sur-Marne, France

[21] Appl. No.: 261,980

[22] Filed: May 8, 1981

[30] Foreign Application Priority Data

May 9, 1980 [FR] France ..... 80 10364

[51] Int. Cl.[3] ..... H01H 13/56

[52] U.S. Cl. ..... 200/153 J; 200/243; 200/314; 200/328

[58] Field of Search ..... 200/153 J, 328, 314, 200/243

[56] References Cited

U.S. PATENT DOCUMENTS

| | | | |
|---|---|---|---|
| 3,272,949 | 9/1966 | Lawrence | 200/243 |
| 3,582,592 | 6/1971 | Schadow | 200/153 J |
| 3,766,346 | 10/1973 | Alexander | 200/153 J |

FOREIGN PATENT DOCUMENTS

| | | | |
|---|---|---|---|
| 2411463 | 9/1975 | Fed. Rep. of Germany | 200/153 J |
| 361329 | 5/1962 | Switzerland | 200/328 |

*Primary Examiner*—John W. Shepperd

*Attorney, Agent, or Firm*—Browdy & Neimark

[57] ABSTRACT

An electrical switch which is mainly adapted for household electrical appliances is made of a hollow main body in which a push-button can slide from top to bottom and from bottom to top. The lower portion of the push-button supports two lugs maintaining the blades carrying the mobile terminals cooperating with studs rigidly connected to square-pieces fixed on the bottom of the main body. The lugs carry laterally a hollow heart-shaped cam in which can circulate a dog fixed to the upper portion of a rock-piece pivotally mounted on a pin rigidly connected to the inner wall of the body, thereby allowing opening and closing of at least one electrical circuit by the switch.

3 Claims, 14 Drawing Figures

ELECTRICAL SWITCH WITH A VERTICAL PUSH-PIECE

BACKGROUND OF THE INVENTION

The present invention has for its object an electrical switch with a vertical push-piece, of a simple construction but nevertheless of a great safety of use, this switch being easily fixable to control boards of various machines and being able to control simultaneously one or more electrical circuits.

DISCLOSURE OF THE PRIOR ART

Electrical switches with a vertical push-piece, most often having a small volume, are already known, but hitherto such switches, which have to be incorporated into the control board of various machines, and in particular of machines for household electrical appliances, have not given full satisfaction since their sturdiness is not sufficient due to their small volume. Moreover, their presentation is not always perfect.

The present invention remedies such disadvantages by providing an electrical switch with vertical push-piece having a latching rock-piece the pivoting axis of which passes by its center of gravity, thereby obtaining a perfect balance of this rock-piece. Thus can be obtained successive locking and unlocking operations which are perfectly smooth since the friction forces are very small and the members forming the electrical switch are very reliable whatever be the orientation or position of the switch, viz. even if the switch is in a practically horizontal position.

Moreover, the construction of such a switch provides an excellent contact since the mobile terminals start by resting obliquely on the contact studs, then parallelly with a slight rolling displacement so as to enable a self-cleaning of the contact studs when closing or opening the switch.

SUMMARY OF THE INVENTION

According to the invention, the electrical switch is formed of a main hollow body in which can slide, from top to bottom and from bottom to top, a push-button the lower portion of which supports two lugs maintaining blades carrying mobile terminals cooperating with studs rigidly connected to square-pieces fixed in the bottom portion of the main body, and moreover the lug carries sideways a hollow heart-shaped cam in which can circulate a dog fixed to the upper portion of a rock-piece articulated in a balanced way to a pin rigidly connected to the inner wall of the body, thereby permitting opening and closing at least one electrical circuit by the switch.

According to a further feature of the invention, each of the blades carrying the terminals is maintained on hooks rigidly connected to the lugs of the push-button by a spring centered on at least one finger rigidly connected onto the underneath portion of the push-button.

Various other features of the invention will become more apparent from the following detailed description.

BRIEF DESCRIPTION OF THE DRAWINGS

An embodiment of the invention is shown, by way of example, in the accompanying drawings wherein.

DESCRIPTION OF THE INVENTION

Figure 1:
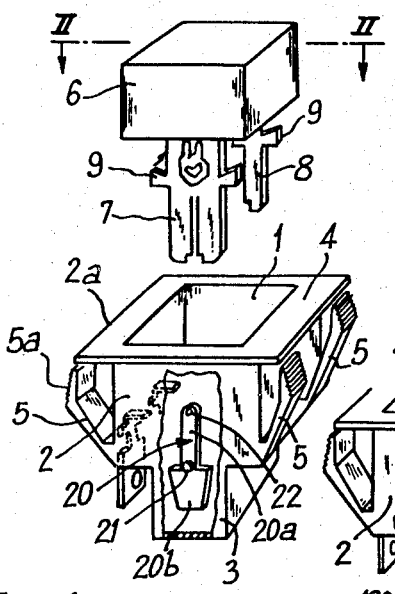
FIG. 1 is a perspective view, partly broken away, of the electrical switch with a vertical push-piece.

FIG. 1 shows the main body 1 of the switch formed by a box 2 of a substantially cubic shape and which is extended in its central lower portion by a narrow and elongated receptacle 3. The upper edge 2*a* of the box 2 ends by a frame 4 intended for resting on the outer surface of the control case in which is incorporated the switch which is maintained by resilient lugs 5 at the upper end of which are provided grooved surfaces 5*a*. As a matter of fact, this fixation device of the switch is known as such.

Figure 2:
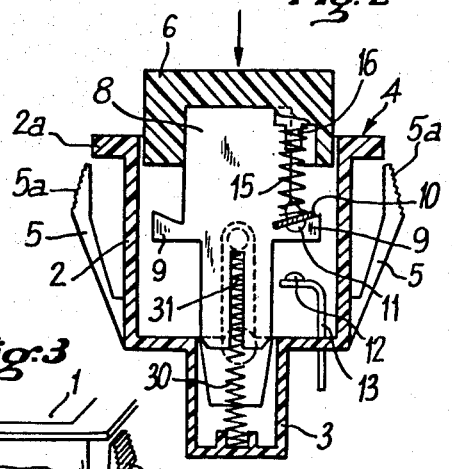
FIG. 2 is a cross-sectional view of the switch, taken substantially along line II—II of FIG. 1.
Figure 5:
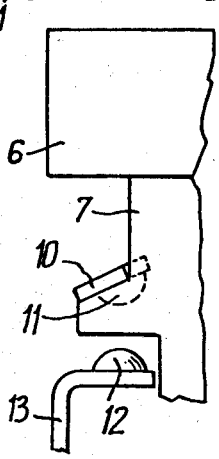
FIGS. 5 and 6 show the position of the mobile terminals relative to the fixed studs.
Figure 6:
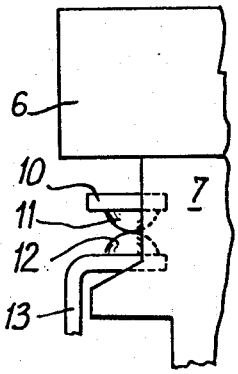
Figure 7:
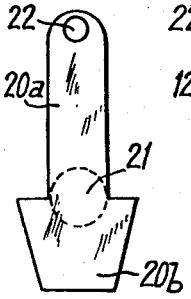
FIG. 7 is an enlarged elevation view of another part of the switch.
Figure 8:
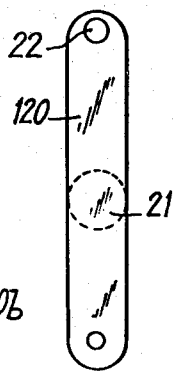
FIG. 8 is an enlarged side elevation view of an alternative of the part of FIG. 7.
Figure 9:
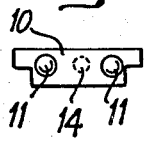
FIG. 9 is a plan view of the support for the mobile terminals.

The push-button, shown at 6, is formed of a solid body downwardly prolongated by lugs 7, 8. The lugs carry hooks 9 for maintaining blades 10 (see FIG. 9) at the lower portion of which are secured mobile terminals for cooperating with fixed studs 12 mounted on conductive square pieces 13 extending through the bottom of the box 2 (see FIG. 2). The over-thickness portion 14 in the blades 10 (see FIG. 9) permits centering a spring 15 maintained by a finger 16 rigidly connected to the underportion of the push-button 6 (see FIG. 2). Thus, the spring 15 maintains firmly the blades 10 on the oblique hooks 9 which can be insidely inclined (see FIGS. 1 and 2) or outsidely inclined (see FIGS. 5 and 6).

A latching rock-piece 20 is pivotally mounted on a pin 21 rigidly connected to one of the transverse sides of the box 2. This latching rock-piece 20 is formed of two portions, a first portion 20*a* is long and the other portion 20*b* is short, the portion 20*a* being provided at its upper end with a dog 22 situated above the pivoting pin 21. The two portions 20*a* and 20*b* of the latching rock-piece 20 are designed so that their resulting center of gravity passes through the pivoting pin 21. Such conditions enable construction of this latching rock-piece in a simple manner from plastics or metallic materials.

This latching member is therefore not sensitive to gravity and to heat; thus the push switch of the invention can be mounted in whatever position contrary to the other push switches, as presently manufactured, which are all provided with various latching members which are balanced by gravity, thereby leading to the necessity of providing a compensation for the latter.

By way of example, one currently uses a latching ball necessitating grease which hardens with time. One can also use latching washers made of plastics material which have to be curved, and are therefore all the more complex to make since the curve disappears when the temperature increases, mainly when the switch is used in appliances or machines needing heat for their operation.

Figure 4:
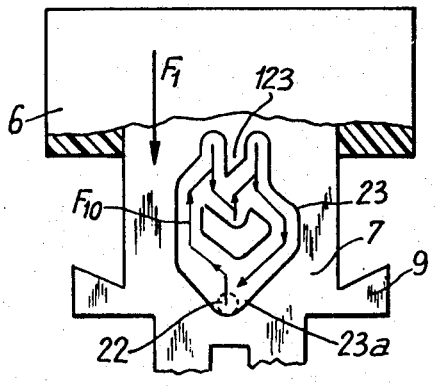
FIG. 4 is an enlarged elevation view of an element of the switch.
Figure 10:
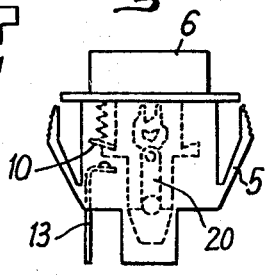
FIGS. 10 and 11 show respectively the switch open and the switch closed.
Figure 11:
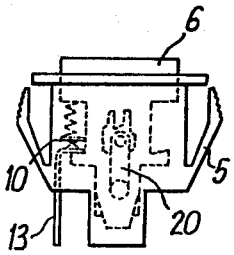

The dog 22 is adapted for cooperating with a cam 23 having substantially the shape of a hollow heart in the lug 7 of the push-button 6, so that by pressing the push-button 6 in direction of arrow $F_1$ (FIG. 4), the dog 22 which is in the lower portion of the hollow cam 23 (see FIG. 10) follows a movement defined by arrows $F_{10}$ (see FIG. 4), thereby enabling to close electrical circuits controlled by the switch by applying the mobile terminals 11 onto the fixed studs 12.

Since the dog 22, by following the heart-shaped cam 23, makes slightly the members of the push-button 6 to move transversely, there is a slight friction of the mobile terminals 11 relative to the fixed studs 12 and therefore a self-cleaning of the terminals 11 providing a perfect contact for the passage of the electrical current.

It should be noticed that a spring 30 placed behind the rock-piece 20 has a tendency to push back the push-button 6 upwards by bearing against the bottom portion of the receptacle 3 and against a vertical guide 31 rigidly connected to the lug 7. There is thus obtained an easy return to the open portion of the switch when the dog 22 has left the central portion 23*a* of the heart-shaped cam 23.

Figure 3:
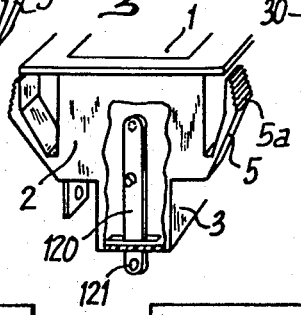
FIG. 3 shows in a partial perspective view a modified element of the switch.

In FIG. 3, the latching rock-piece 120 is made of a bar extending through the bottom portion of the receptacle 3 so as to enable the control of the rock-piece 120 from a point 121, either through a system of rods or through an electromagnet, thereby permitting a remote control of the switch.

As can be seen, it is possible easily to make simple or double switches with a extremely limited number of parts, the switch having a size sufficient for suitably withstanding the required work, but also for being easily operated, and this all the more that the mobility of the terminals 11 which are slightly self-cleaning provides a good flow of the current.

The various parts forming the switch are made mainly of natural or synthetic plastics material, the dielectric character of which is acknowledged and the strength of which is extremely good. Only the square-pieces 16, the blades 10, the terminals and studs 11, 12 as well as the springs are made of metal.

The invention is not limited to the embodiment shown and described in detail and several modifications may be carried out without departing from the scope of the invention as shown in the appendent claims. In particular, the heart-shaped cam 23 can have in its central portion 123 (see FIG. 4) a flat portion connected to an inclined portion permitting an automatic and remote control operation of the switch.

Figure 13:
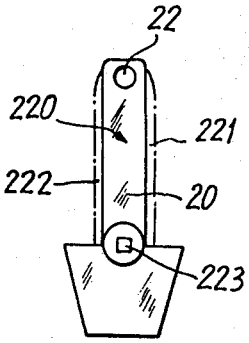
FIG. 13 shows a slight alternative of the embodiment of FIG. 7.

Actually, and as shown in FIG. 13, the rock-piece 220 can be slightly altered as regards to its rotation pin 223 which can be square-shaped. In any way, such modifications result in the rock-piece being perfectly balanced, and therefore able to assume constantly any position.

Figure 12:
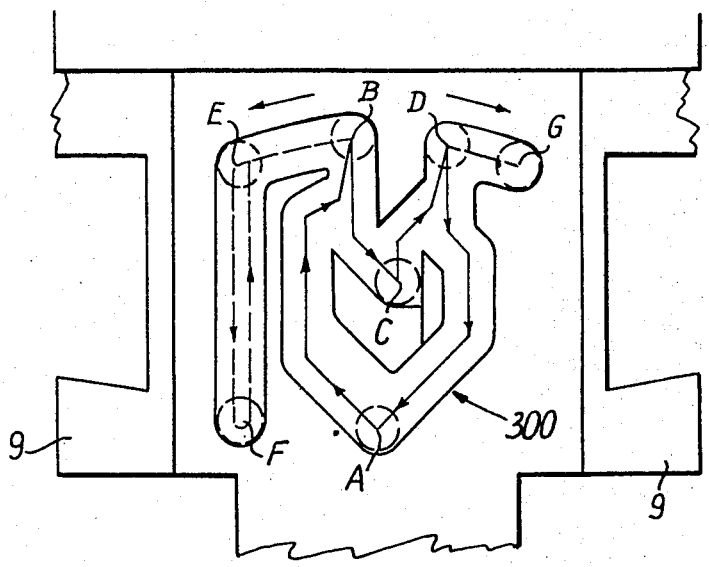
FIG. 12 is a diagrammatic elevation view showing a modification of an element of the switch.
Figure 12A:
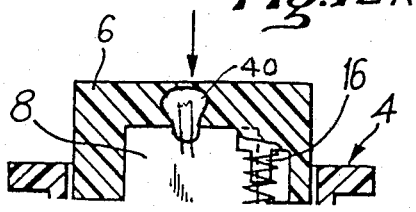
FIG. 12A shows a variation of FIG. 2.

It is the reason why, in FIG. 12, the cam 300 which replaces the heart-shaped cam 23, enables the dog 22 which is normally in position A, to reach easily position B when pressing the push-button 6.

Then, when one stops pressing the push-button, the dog 22 assumes position C (locked position, circuit closed); if one presses again the push-piece, the dog 22 escapes to position D; then by releasing the pressure on the push-piece, the dog 22 resumes its position A (switch open; circuit open). When by pressing the push-piece one brings the dog 22 from position A to position B and one pivots left-wise the whole unit towards position E, and, when one releases the pressure applied on the push-piece, one obtains an apparatus with momentaneous action, the dog 22 circulating from position E to position F, and from position F to position E.

From the rest position A and by operating twice the push-piece, it is also possible to bring the dog 22 in position D and from there, by pushing it slightly towards the right, to position G. The push-button remains sunk and can no more be operated, and there is thus obtained, with a standard circuit, a luminous indicator 40 the cap of which is provided by the push-piece 6.

I claim:

1. An electrical switch with vertical push-piece, comprising a main hollow body (1) in which can slide from top to bottom position and from bottom to top position a push-button (6) having a lower portion which supports two lugs (7, 8) maintaining blades (10) carrying mobile terminals (11) cooperating with studs (12) rigidly connected to squarepieces (13) fixed in a bottom portion of the main body (1), means for biasing said push-button in the top position, the lug (7) further carrying laterally a hollow heart-shaped cam (23) in which can circulate a dog (22) fixed at an upper portion of a rock-piece (20) pivotally mounted on a pin (21) rigidly connected to inner wall of the main body (1), thereby allowing opening and closing of at least one electrical circuit by the switch, each of the blades (10) carrying mobile terminals (11) being maintained in an inclined position on hooks (9) rigidly connected to the lugs (7, 8) of the push-button (6) by a spring (15) centered on a finger (16) rigidly connected below the push-button (6), the axis (21) of the rock-piece (20) being placed at center of gravity of said rock-piece, whereby the rock-piece (20) is functional regardless of its attitude.

2. A switch according to claim 1, wherein the rock-piece (120) extends through bottom (3) of the main body (1) of the switch for enabling a remote control of the switch.

3. A switch according to claim 1, further comprising means to use the push-piece as a luminous indicator, wherein in addition to the heart-shaped cam (300), there is connected a circuit for obtaining a momentaneous action switch, so that a fixed position for activating a luminous indicator is provided by pushing the rock-piece (220) in a direction contrary to the previous displacement.

* * * * *